US008664877B2

(12) United States Patent
Jin et al.

(10) Patent No.: US 8,664,877 B2
(45) Date of Patent: Mar. 4, 2014

(54) LIGHT DRIVING APPARATUS

(75) Inventors: Jung Ho Jin, Hwaseong-si (KR); Hyun Il Park, Seoul (KR); Ju Seong Kim, Seoul (KR)

(73) Assignee: Dongwoon Anatech Co., Ltd., Seoul (KR)

( * ) Notice: Subject to any disclaimer, the term of this patent is extended or adjusted under 35 U.S.C. 154(b) by 147 days.

(21) Appl. No.: 13/427,720

(22) Filed: Mar. 22, 2012

(65) Prior Publication Data

US 2012/0249005 A1 Oct. 4, 2012

(30) Foreign Application Priority Data

Mar. 31, 2011 (KR) ..... 10-2011-0029240

(51) Int. Cl.
*H05B 41/16* (2006.01)
*H05B 41/24* (2006.01)

(52) U.S. Cl.
USPC ..... 315/247; 315/185 R; 315/209 R; 315/282; 315/287

(58) Field of Classification Search
None
See application file for complete search history.

(56) References Cited

U.S. PATENT DOCUMENTS 7,262,559 B2 * 8/2007 Tripathi et al. ..... 315/291
8,519,642 B2 * 8/2013 Ahn et al. ..... 315/312

FOREIGN PATENT DOCUMENTS

KR 10-0877521 1/2009
KR 10-0916850 9/2009
KR 10-0940042 2/2010
WO WO 2004/060023 7/2004

* cited by examiner

*Primary Examiner* — Anh Tran
(74) *Attorney, Agent, or Firm* — Ohlandt Greeley Ruggiero & Perle L.L.P.

(57) ABSTRACT

The present disclosure relates to a light driving apparatus which may stably drive an LED light at a normal operation by feeding back the output voltage of the LED light and stably drive the LED light at an abnormal operation by feeding back the voltage supplied to the LED light, and the light driving apparatus includes: a rectifier circuit; a transformer circuit; a power factor correction circuit; a smoothing circuit; a constant-current driving circuit; a dimming control circuit; a photo-coupler; a sample and hold circuit; a first photo-coupler driving circuit for feeding back the voltage output from the sample and hold circuit and applying the feedback voltage as a driving voltage of the photo-coupler; and a second photo-coupler driving circuit for feeding back the voltage output from the smoothing circuit and supplied to the LED module and supplying the feedback voltage as a driving voltage of the photo-coupler.

12 Claims, 6 Drawing Sheets

LIGHT DRIVING APPARATUS

CROSS-REFERENCE TO RELATED APPLICATION

This application claims priority to Korean Patent Application No. 10-2011-0029240, filed on Mar. 31, 2011, and all the benefits accruing therefrom under 35 U.S.C. §119, the contents of which in its entirety are herein incorporated by reference.

BACKGROUND

1. Field

The present disclosure relates to a light driving apparatus, and more particularly, to a light driving apparatus which may stably drive an LED light.

2. Description of the Related Art

Recently, the interest on an LED light operated with low power consumption and having brightness comparable with a light device such as an incandescent lamp is increasing.

In particular, a light driving apparatus for controlling a constant current to flow through the LED light so as to operate the LED light is being actively studied and developed. The light driving apparatus has various light displaying functions, and such various light displays may be performed by changing dimming of LED elements arranged to connect in parallel.

FIG. 1 is a diagram a general light driving apparatus, and FIG. 2 is a diagram exemplarily showing an output voltage and an LED current format according to a dimming control signal of the general light driving apparatus.

Referring to FIGS. 1 and 2, the general light driving apparatus includes a rectifier circuit 110 for rectifying the full wave output from an AC power source 100, a transformer circuit 120 for changing the magnitude of the voltage output from the rectifier circuit 110 and outputting the voltage, a power factor correction circuit 130 for detecting a load size by using a feedback voltage, controlling the output voltage of the transformer circuit 120 according to the detected load size, and compensating a power factor of the power output from the AC power source 100, a smoothing circuit 140 for smoothing the voltage output from the transformer circuit 120 to output a stable DC voltage and supplying the output voltage VOUT to an LED module 10, a constant-current driving circuit 150 for controlling an LED current ILED so that a constant current flows through the LED module 10, a dimming control circuit 160 for controlling a current flow of the LED module 10 by means of a pulse width modulation (PWM) method to control dimming, and a photo-coupler 170 operated by the output voltage Vo of the LED module 10 transmitted through the constant-current driving circuit 150 and applying a feedback voltage to the power factor correction circuit 130.

The light driving apparatus is classified into a primary side and a secondary side based on the transformer circuit 120 and the photo-coupler 170. The primary side includes the AC power source 100, the rectifier circuit 110 and the power factor correction circuit 130, and the secondary side includes the LED module 10, the smoothing circuit 140, the constant-current driving circuit 150 and the dimming control circuit 160.

Here, the LED module 10 is configured so that LED electrodes are connected in series, and it may emit a single light or various lights, selectively.

In addition, the transformer circuit 120 is composed of a plurality of transformers TF1 and TF2. Here, the first transformer TF1 of the primary side functions to transmit the voltage output from the rectifier circuit 110 to the second transformer TF2 of the secondary side. In addition, the second transformer TF2 functions to convert the voltage transmitted from the first transformer TF1 and output the converted voltage.

The power factor correction circuit 130 includes a power factor compensation controller 132 for squaring a phase of the AC power source voltage output from the AC power source 100 with a phase of the AC input current IAC and compensating a power factor of the AC power source 100, and a switch element SW such as an MOSFET for switching according to the control of the power factor compensation controller 132 to adjust the output voltage of the transformer circuit 120.

The power factor compensation controller 132 receives a AC power source voltage distributed by predetermined resistances R1, R2, R3 to square phases of the AC power source voltage and the AC input current IAC, and adjusts the gate voltage VG of the switch element SW according to the load size of the LED module 10 to control a current capacity flowing through the switch element SW so that the output voltage of the transformer circuit 120 may be adjusted.

In other words, as a high voltage is applied to an input terminal OPTO of the photo-coupler 170 so that the photo-coupler 170 is operated by the high voltage, the power factor compensation controller 132 determines that a small load is applied to the LED module 10 and applies a low gate voltage VG to the switch element SW, so that the current capacity flowing through the switch element SW is lowered to decrease the output voltage of the transformer circuit 120. Meanwhile, as a low voltage is applied to the input terminal OPTO of the photo-coupler 170 so that the photo-coupler 170 is operated by the low voltage, the power factor compensation controller 132 determines that a heavy load is applied to the LED module 10 and applies a high gate voltage VG to the switch element SW, so that the current capacity flowing through the switch element SW rises to increase the output voltage of the transformer circuit 120.

The smoothing circuit 140 includes a predetermined capacitor connecting to the output terminal of the transformer circuit 120 in parallel.

The dimming control circuit 160 includes a first switch element SW1 switched to turn on/off according to a PWM signal PWM generated by a PWM controller to adjust the current flow of the LED module 10.

In the general light driving apparatus as described above, when controlling the dimming of the LED light, the range of fluctuation of the voltage magnitude of the input terminal OPTO of the photo-coupler 170 is very large and unstable according to the logic value of the PWM signal PWM. Therefore, as shown in FIG. 2, when the logic value of the PWM signal PWM is high, the output voltage VOUT of the light driving apparatus supplied to the LED module 10 rises up to an over voltage protection (OVP), and in the transition region of the logic value, an over-current occurs at the LED module 10 which shortens the life span of LED elements of the LED module 10.

In addition, in the general light driving apparatus, in the case where the LED module 10 is opened due to surge generation or external factors and thus is operated abnormally, as shown in FIG. 3, the LED current ILED substantially does not flow and the output voltage Vo of the LED module 10 is lowered to the low voltage. At this time, since the photo-coupler 170 is operated due to only the output voltage Vo of the LED module 10 to supply the feedback voltage to the power factor correction circuit 130, the situation where the LED current ILED does not flow through the power factor correction circuit 130 is determined as a heavy load is applied, and the output voltage of the transformer circuit 120, namely the voltage VOUT supplied to the LED module 10 is boosted to the saturation voltage, for example up to about 300V, thereby causing accidents such as damaging a circuit or breaking an element.

SUMMARY

The present disclosure is directed to providing a light driving apparatus which feeds back any one of the output voltage of an LED light and the voltage supplied to the LED light, and adjusts the voltage supplied to the LED light according to the magnitude of the feedback voltage to stabilize the driving current of the LED light.

In one aspect, there is provided a light driving apparatus, which includes: a rectifier circuit for rectifying a full wave output from a power source; a transformer circuit for converting a magnitude of the voltage output from the rectifier circuit and outputting the converted voltage; a power factor correction circuit for detecting a load size by using a feedback voltage, and adjusting the output voltage of the transformer circuit according to the detected load size to compensate a power factor of the power source; a smoothing circuit for smoothing the voltage output from the transformer circuit, outputting the smoothed voltage, and supplying the output voltage to an LED module; a constant-current driving circuit for controlling an LED current so that a constant driving current flows through the LED module; a dimming control circuit for controlling the constant-current driving circuit to adjust a current flow of the LED module so that dimming is controlled; a photo-coupler for applying the feedback voltage to the power factor correction circuit; a sample and hold circuit operated according to the control of the dimming control circuit to maintain a consistent output voltage; a first photo-coupler driving circuit for feeding back the voltage output from the sample and hold circuit and applying the feedback voltage as a driving voltage of the photo-coupler; and a second photo-coupler driving circuit for feeding back the voltage output from the smoothing circuit and supplied to the LED module, and supplying the feedback voltage as a driving voltage of the photo-coupler.

The power factor correction circuit may decrease the magnitude of the output voltage of the transformer circuit as the photo-coupler is operated by a high voltage, and may increase the magnitude of the output voltage of the transformer circuit as the photo-coupler is operated by a low voltage.

The output terminal of the first photo-coupler driving circuit and the output terminal of the second photo-coupler driving circuit may respectively have a diode for preventing a reversal of current, and may connect to the input terminal of the photo-coupler in parallel.

The second photo-coupler driving circuit may include: a plurality of resistance elements for distributing the voltage supplied to the LED module; a first amplifier for amplifying the voltage corresponding to a difference value between the voltage distributed by any one resistance element among the plurality of resistance elements and a first reference voltage and outputting the amplified voltage; a second amplifier for amplifying the voltage corresponding to a difference value between the voltage output from the first amplifier and a second reference voltage and outputting the amplified voltage; and a reference voltage supplier for supplying the reference voltages to the first amplifier and the second amplifier.

As the driving of the constant-current driving circuit stops according to the control of the dimming control circuit, the power factor correction circuit may decrease the output voltage of the transformer circuit so that the first photo-coupler driving circuit applies a high voltage capable of stopping the transformer circuit to the photo-coupler.

The first photo-coupler driving circuit may include: a third amplifier for amplifying the voltage corresponding to a difference value between the voltage output from the sample and hold circuit and a third reference voltage and outputting the amplified voltage; a fourth amplifier for amplifying the voltage corresponding to a difference value between the voltage output from the third amplifier and a fourth reference voltage and outputting the amplified voltage; a reference voltage supplier for supplying the reference voltages to the third amplifier and the fourth amplifier; and a switch element switched by the control of the dimming control circuit so that, as the driving of the constant-current driving circuit stops, the power factor correction circuit decreases the output voltage of the transformer circuit to the fourth reference voltage of the fourth amplifier, thereby applying a high voltage capable of stopping the operation of the transformer circuit.

The constant-current driving circuit may include: a zener diode connected to a ground terminal; a sense resistor connected to the output terminal of the LED module; a fifth amplifier for amplifying the voltage corresponding to a difference value between the voltage applied to the first zener diode and the voltage applied to the sense resistor and outputting the amplified voltage; and a first switch element switched to turn on/of according to the voltage output from the fifth amplifier to adjust a current flow of the LED module.

The dimming control circuit may include: a dead time unit for receiving a pulse width modulation (PWM) signal generated from a PWM controller and outputting a dimming control signal and a S/H control signal; and a second switch element switched to turn on/off by the dimming control signal to transmit the output voltage of the fifth amplifier as a driving signal of the first switch element or intercept the transmission, thereby controlling the operation of the first switch element.

When receiving a PWM signal from the PWM controller, the dead time unit may output the input PWM signal as a dimming control signal, and may endow a dead time region corresponding to each non-overlap time region to a transition region of a logic value of the PWM signal to generate and output the S/H control signal.

The sample and hold circuit may sample the output voltage when the S/H control signal output from the dimming control circuit has a first logic value, and in the case where the S/H control signal make a transition from the first logic value to a second logic value, the sample and hold circuit may output the output voltage sampled when the S/H control signal has the first logic value.

The sample and hold circuit may include: a capacitor charged with the output voltage of the LED module; a sixth amplifier for buffering the output voltage of the LED module or the voltage corresponding to a difference value between the charge voltage of the capacitor and the input voltage as a unit gain and outputting the buffered voltage, the output voltage being fed back and used as the input voltage; and a third switch element switched to turn on/off according to the logic value of the S/H control signal to transmit the output voltage of the LED module to the sixth amplifier and the capacitor or intercept the transmission.

After a time corresponding to a first dead time region passes from the point when the logic value of the dimming control signal becomes the second logic value, in the case where the logic value of the S/H control signal becomes the first logic value, the third switch element may be switched to turn on during the time when the first logic value is maintained from the point when the logic value becomes the first logic value to transmit the output voltage of the LED module to the input terminal of the sixth amplifier and the capacitor, and in the case where the logic value of the S/H control signal becomes the second logic value, the third switch element may be switched to turn off during the time when the second logic value is maintained from the point that the logic value becomes the second logic value to intercept the transmission of the output voltage of the LED module to the input terminal of the sixth amplifier and the capacitor.

If the light driving apparatus according to the present disclosure is used, since any one of the output voltage of the LED light and the voltage supplied to the LED light is fed back depending on situation and the voltage supplied to the LED light is adjusted according to the magnitude of the feedback voltage to stabilize the driving current of the LED light, it is possible to always operate the LED light stably, to prevent an accident such as circuit damage and element breakdown from occurring, and to further enhance the life span of the LED light.

BRIEF DESCRIPTION OF THE DRAWINGS

The above and other aspects, features and advantages of the disclosed exemplary embodiments will be more apparent from the following detailed description taken in conjunction with the accompanying drawings in which.

| <Detailed Description of Main Elements> | |
|---|---|
| 10: | LED module |
| 100: | AC power source |
| 110: | rectifier circuit |
| 120: | transformer circuit |
| 130: | power factor correction circuit |
| 132: | power factor compensation controller |
| 140: | smoothing circuit |
| 150: | constant-current driving circuit |
| 160: | dimming control circuit |
| 162: | dead time unit |
| 170: | photo-coupler |
| 180: | sample and hold circuit |
| 190: | first photo-coupler driving circuit |
| 192: | pole-zero compensation unit |
| 200: | second photo-coupler driving circuit |
| 202: | low pass filter |

DETAILED DESCRIPTION

Hereinafter, configurations and operations of a light driving apparatus according to an embodiment of the present disclosure will be described in detail with reference to the accompanying drawings.

Figure 1:
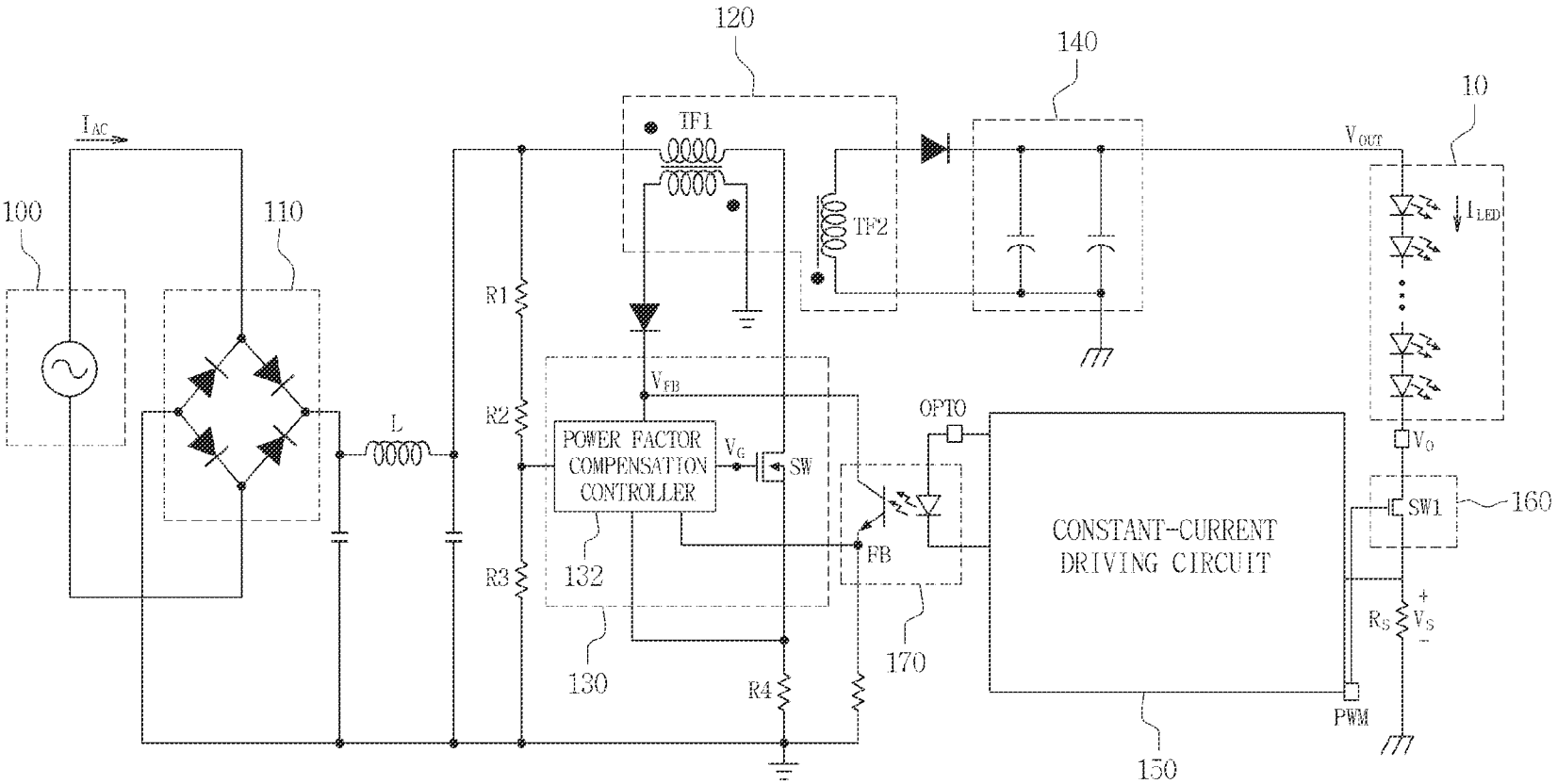
FIG. 1 is a diagram showing a general light driving apparatus.
Figure 2:
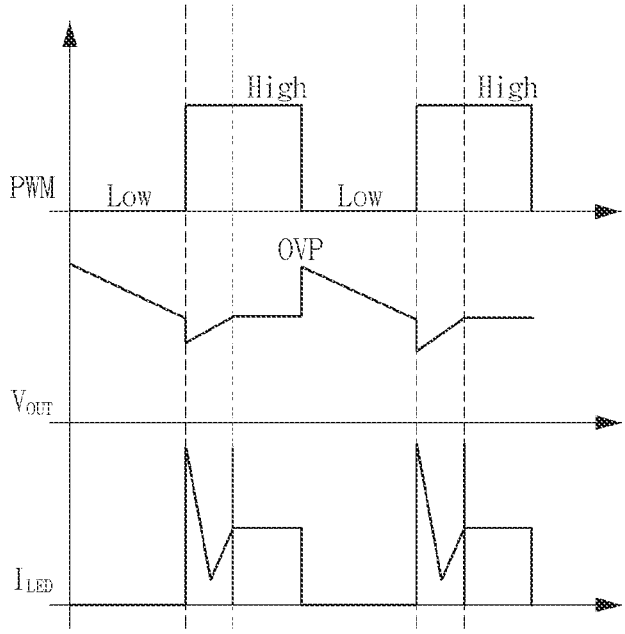
FIGS. 2 and 3 are graphs for illustrating operations of the general light driving apparatus.
Figure 3:
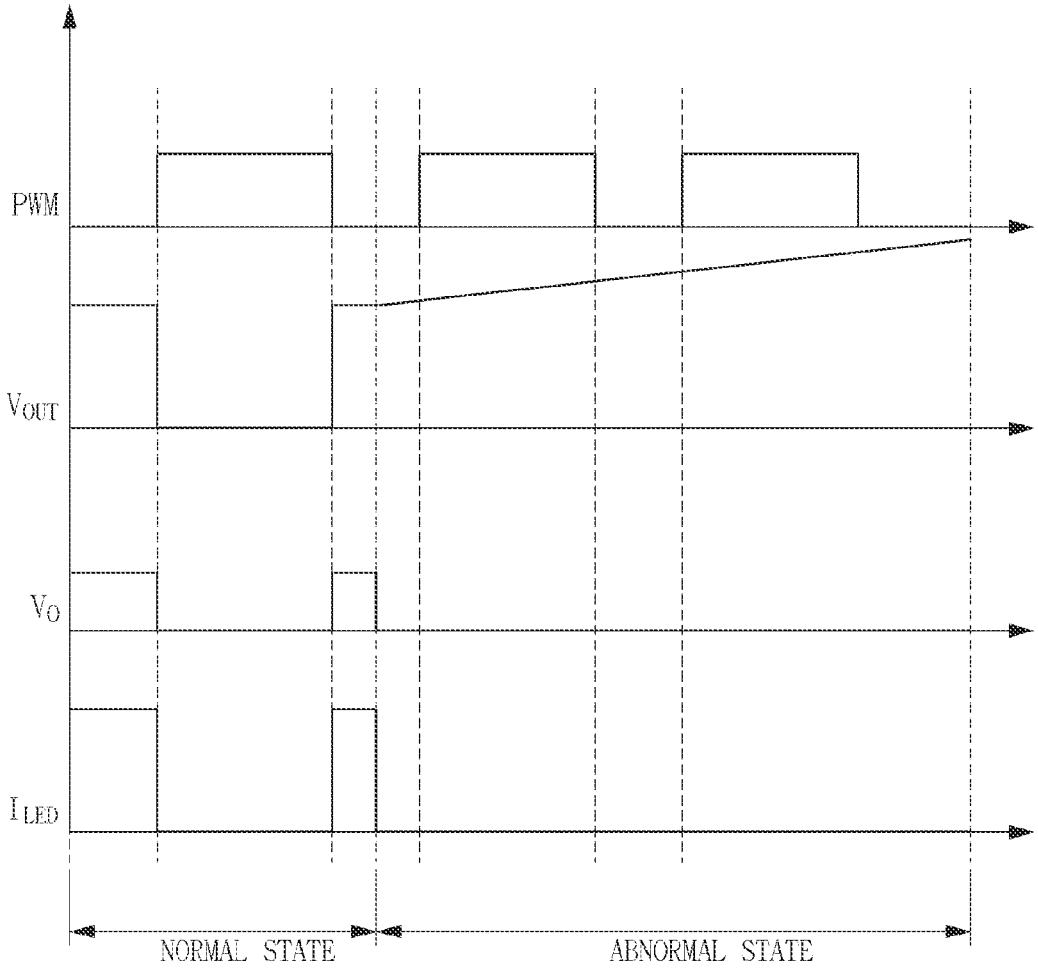
Figure 4:
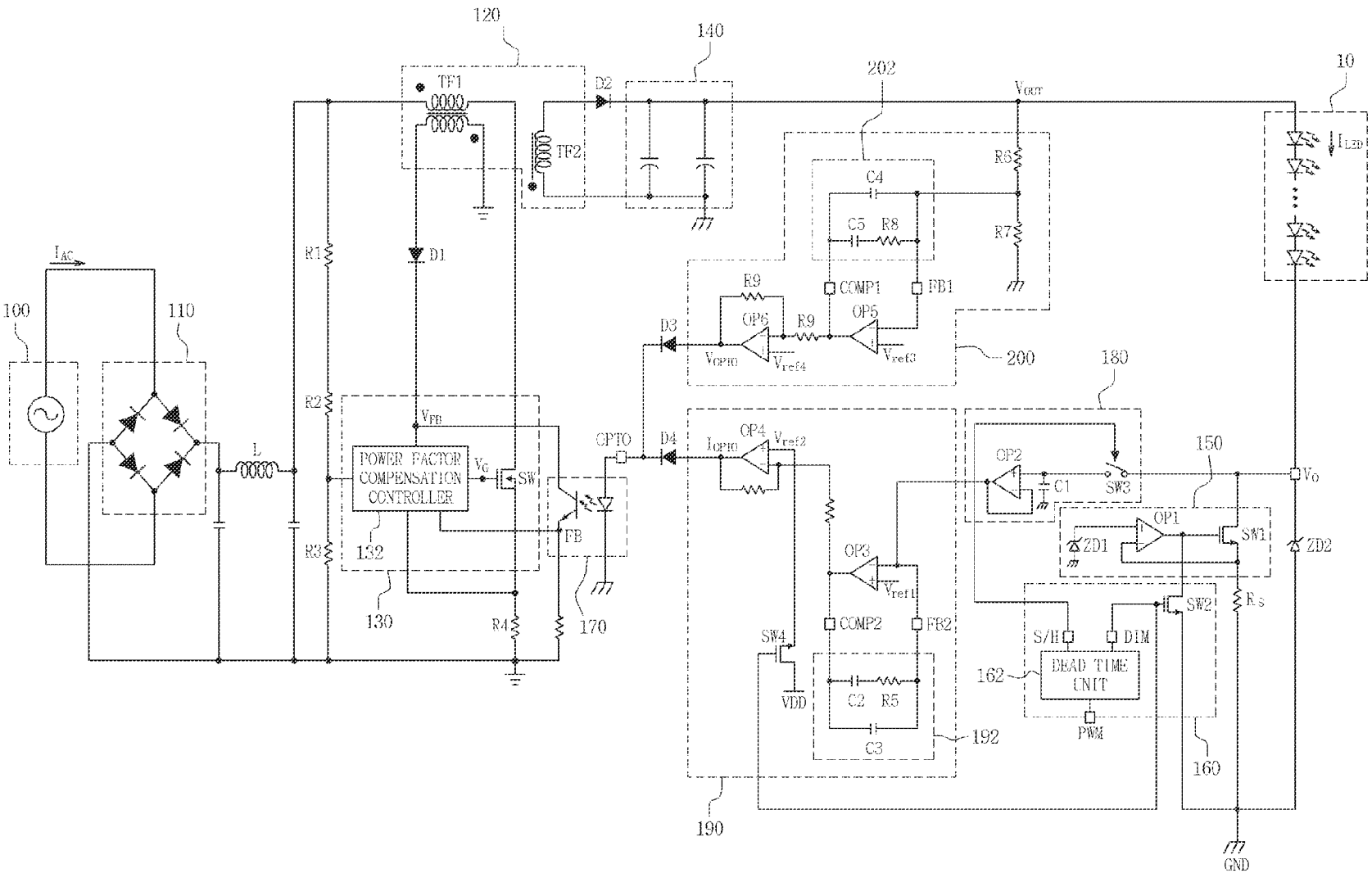
FIG. 4 is a diagram showing a light driving apparatus according to an embodiment of the present disclosure.

Referring to FIG. 4, the light driving apparatus according to an embodiment of the present disclosure includes a rectifier circuit 110 for rectifying a full wave output from an AC power source 100, a transformer circuit 120 for converting a magnitude of the voltage output from the rectifier circuit 110 and outputting the converted voltage, a power factor correction circuit 130 for detecting a load size by using a feedback voltage and adjusting the output voltage of the transformer circuit 120 according to the detected load size to compensate a power factor of the power output from the AC power source 100, a smoothing circuit 140 for smoothing the voltage output from the transformer circuit 120 to output a stable DC voltage and supplying the output voltage VOUT to an LED module 10, a constant-current driving circuit 150 for controlling an LED current ILED so that a constant driving current flows through the LED module 10, a dimming control circuit 160 for controlling the constant-current driving circuit 150 in a pulse width modulation (PWM) manner to adjust a current flow of the LED module 10 so that dimming is controlled, a photo-coupler 170 for applying the feedback voltage to the power factor correction circuit 130, a sample and hold circuit 180 operated according to the control of the dimming control circuit 160 to maintain a consistent output voltage, a first photo-coupler driving circuit 190 for feeding back the voltage output from the sample and hold circuit 180 and applying the feedback voltage as a driving voltage of the photo-coupler 170, and a second photo-coupler driving circuit 200 for feeding back the output voltage VOUT output from the smoothing circuit 140 and supplied to the LED module 10 and supplying the feedback voltage as a driving voltage of the photo-coupler 170. In addition, a second zener diode ZD2 may be connected to the output terminal of the LED module 10 in order to restrain the rise of the output voltage Vo of the LED module 10.

The light driving apparatus according to the present disclosure is classified into a primary side and a secondary side based on the transformer circuit 120 and the photo-coupler 170. The primary side may include the AC power source 100, the rectifier circuit 110 and the power factor correction circuit 130, and the secondary side may include the LED module 10, the smoothing circuit 140, the constant-current driving circuit 150, the dimming control circuit 160, the sample and hold circuit 180, the first photo-coupler driving circuit 190 and the second photo-coupler driving circuit 200.

Meanwhile, the constant-current driving circuit 150, the dimming control circuit 160, the sample and hold circuit 180, the first photo-coupler driving circuit 190 and the second photo-coupler driving circuit 200 may be implemented in a single IC.

In addition, the output terminal IOPTO of the first photo-coupler driving circuit 190 and the output terminal VOPTO of the second photo-coupler driving circuit 200 connect to the input terminal OPTO of the photo-coupler 170 in parallel, and diodes D3 and D4 for preventing the reversal of current are respectively provided at the output terminals IOPTO and VOPTO. Due to this circuit configuration, a greater one of the voltage at the output terminal IOPTO of the first photo-coupler driving circuit 190 and the voltage at the output terminal VOPTO of the second photo-coupler driving circuit 200 is applied to the input terminal OPTO of the photo-coupler 170. At this time, as photo-coupler 170 is operated by a high voltage, the power factor correction circuit 130 decreases the magnitude of the output voltage of the transformer circuit 120, and as the photo-coupler 170 is operated by a low voltage, the power factor correction circuit 130 increases the output voltage of the transformer circuit 120.

Hereinafter, the configuration of the light driving apparatus according to the present disclosure will be described in more detail. However, since the AC power source 100, the rectifier circuit 110, the transformer circuit 120, the power factor correction circuit 130, the smoothing circuit 140 and the photo-coupler 170, employed in the present disclosure, have the same technical configuration and feature as an AC power source 100, a rectifier circuit 110, a transformer circuit 120, a power factor correction circuit 130, a smoothing circuit 140 and a photo-coupler 170 of a general light driving apparatus, they are not described in detail.

The constant-current driving circuit 150 includes a first zener diode ZD1 connected to a ground terminal, a first amplifier OP1 for amplifying the voltage corresponding to a difference value between the voltage applied to the first zener diode ZD1 and the voltage applied to a sense resistor Rs connected to the output terminal of the LED module 10 and outputting the amplified voltage, and a first switch element SW1 switched to turn on/off by receiving the voltage output from the first amplifier OP1 to adjust the current flow of the LED module 10. For example, the first switch element SW1 may be configured with a power transistor.

In other words, if the first switch element SW1 is switched to turn on by the output of the first amplifier OP1 of the constant-current driving circuit 150, LED current ILED having a consistent magnitude flows through the LED module 10. At this time, the magnitude of the LED current ILED is calculated by dividing the voltage value 'VZD1' applied to the first zener diode ZD1 by the magnitude of the sense resistor Rs.

Meanwhile, the dimming control circuit 160 includes a dead time unit 162 for outputting a dimming control signal DIM and generating and outputting a S/H control signal S/H when receiving the PWM signal PWM generated from the PWM controller, and a second switch element SW2 switched to turn on/off by the dimming control signal DIM to transmit the output voltage of the first amplifier OP1 as a driving signal of the first switch element SW1 or intercept the transmission so as to control the operation of the first switch element SW1.

Figure 5:
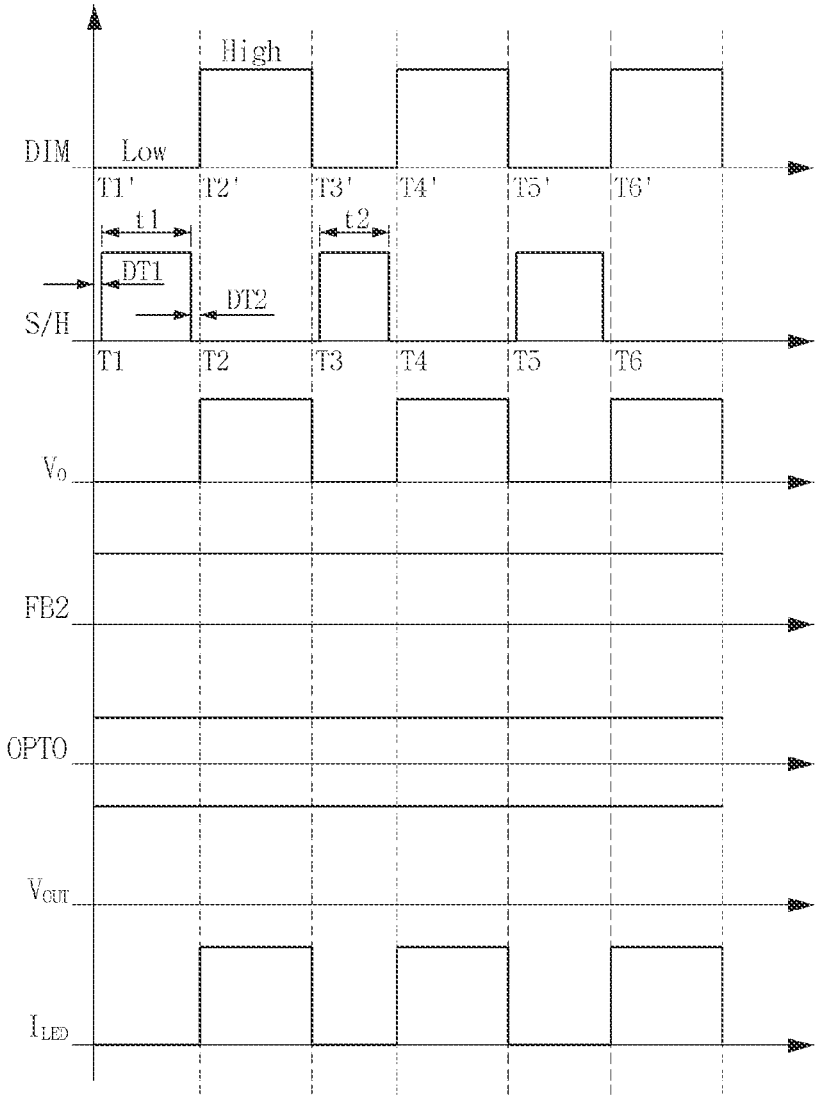
FIGS. 5 and 6 are graphs for illustrating operations of the light driving apparatus according to the embodiment of the present disclosure.

Here, as shown in FIG. 5, if receiving the PWM signal PWM, the dead time unit 162 outputs the input PWM signal PWM to the dimming control signal DIM intactly, and endows dead time regions DT1 and DT2 respectively to a transition region of the logic value of the PWM signal PWM to generate and output the S/H control signal S/H. Here, the S/H control signal S/H has the same phase as the dimming control signal DIM, but has a non-overlap time region corresponding to the dead time regions DT1 and DT2.

In addition, if the logic value of the dimming control signal DIM becomes a second logic value, the second switch element SW2 is switched to turn off during the time when the second logic value is maintained from the point T1' that the logic value becomes the second logic value to transmit the output voltage of the first amplifier OP1 as a driving signal of the to the first switch element SW1, thereby operating the constant-current driving circuit 150. At this time, as the constant-current driving circuit 150 operates, the constant current set to the constant-current driving circuit 150 flows through the LED module 10, and so the output voltage Vo of the LED module 10 drops by a predetermined magnitude.

After that, if the logic value of the dimming control signal DIM becomes the first logic value, the second switch element SW2 is switched to turn on during the time when the first logic value is maintained from the point T2' that the logic value becomes the first logic value to intercept the transmission of the output voltage of the first amplifier OP1 to first switch element SW1, thereby stopping the operation of the constant-current driving circuit 150. As the constant-current driving circuit 150 stops its operation as described above, the current flow of the LED module 10 also stops. Here, the first logic value of the dimming control signal DIM may be high or low. At this time, if the first logic value of the dimming control signal DIM is high, the second logic value may be low. If the first logic value is low, the second logic value may be high.

Meanwhile, the sample and hold circuit 180 samples the output voltage when the S/H control signal S/H output from the dimming control circuit 160 has the first logic value, and in the case where the S/H control signal S/H makes a transition from the first logic value to the second logic value, the sample and hold circuit 180 outputs the output voltage sampled when the logic value is the first logic value, thereby maintaining the output of a constant voltage. Here, the first logic value of the S/H control signal S/H may be, for example, high or low. At this time, if the first logic value of the S/H control signal S/H is high, the second logic value may be low. If the first logic value is low, the second logic value may be high.

The sample and hold circuit 180 includes a capacitor C1 for charging the output voltage Vo of the LED module 10, a second amplifier OP2 for buffering the output voltage Vo of the LED module 10 or the voltage corresponding to a difference value between the charge voltage of the capacitor C1 and the input voltage as a unit gain and outputting the buffered voltage so that the output voltage is fed back and used as the input voltage, and a third switch element SW3 switched to turn on/off according to the logic value of the S/H control signal S/H output from the dead time unit 162 to transmit the output voltage Vo of the LED module 10 to the second amplifier OP2 and the capacitor C1 or intercept the transmission.

Here, in the case where the third switch element SW3 is switched to turn on, the second amplifier receives the output voltage Vo of the LED module from the output terminal of the LED module 10, buffers the voltage corresponding to a difference value between the output voltage Vo of the LED module and its feedback output voltage as a unit gain, and outputs the buffered voltage. Meanwhile, in the case where the third switch element SW3 is switched to turn off, the second amplifier buffers the voltage corresponding to a difference value between the charge voltage of the capacitor C1 charged with the output voltage Vo of the LED module and its feedback output voltage as a unit gain and outputs the buffered voltage, so that a voltage of a constant magnitude is applied to the input terminal FB2 of the first photo-coupler driving circuit 190. Accordingly, the voltage of a constant magnitude output from second amplifier OP2 is always applied to the input terminal FB2 of the first photo-coupler driving circuit 190.

In addition, when the S/H control signal S/H output from the dead time unit 162 has the first logic value, the third switch element SW3 is switched to turn on to transmit the output voltage Vo of the LED module 10 to the input terminal of the second amplifier OP2 and the capacitor C1, and, when the S/H control signal S/H has the second logic value, the third switch element SW3 is switched to turn off to intercept the transmission of the output voltage Vo of the LED module 10 to the input terminal of the second amplifier OP2 and the capacitor C1.

In other words, after the time corresponding to the first dead time region DT1 passes from the point T1' that the logic value of the dimming control signal DIM becomes the second logic value, if the logic value of the S/H control signal S/H becomes the first logic value, the third switch element SW3 is switched to turn on during the time t1 that the first logic value is maintained from the point T1 that the logic value becomes the first logic value to transmit the output voltage Vo of the LED module 10 to the input terminal of the second amplifier OP2 and the capacitor C1. Meanwhile, if the logic value of the S/H control signal S/H becomes the second logic value, the third switch element SW3 is switched to turn off during the time that the second logic value is maintained from the point T2 that the logic value becomes the second logic value to intercept the transmission of the output voltage Vo of the LED module 10 to the input terminal of the second amplifier OP2 and the capacitor C1.

Meanwhile, the first photo-coupler driving circuit 190 includes a third amplifier OP3 for amplifying the voltage corresponding to a difference value between the voltage output from the sample and hold circuit 180 and a first reference voltage Vref1 and outputting the amplified voltage, and a fourth amplifier OP4 for amplifying the voltage corresponding to a difference value between the voltage output from the third amplifier OP3 and a second reference voltage Vref2 and outputting the amplified voltage. At this time, the first photo-coupler driving circuit 190 may further include a reference voltage supplier for supplying a reference voltage.

In addition, the first photo-coupler driving circuit 190 includes a resistor R5 and a plurality of capacitors C2 and C3 in series and in parallel so that a pole-zero compensation unit 192 for compensating a pole-zero point of the feedback loop may be connected to the third amplifier OP3 in parallel. By doing so, the light driving apparatus according to the present disclosure ensures a sufficient phase margin by means of the compensation of the pole-zero point of the feedback loop by the pole-zero compensation unit 192.

In the case where the light driving apparatus operates in a normal state, namely under the situation where the LED module 10 is not open and the LED current ILED keeps flowing, since the output voltage Vo of the LED module 10 is maintained consistently and the voltage supplied to the LED module 10 is maintained lower than a predetermined value (for example, 60V), the first photo-coupler driving circuit 190 outputs a voltage, higher than the second photo-coupler driving circuit 200, having a predetermined magnitude to the input terminal OPTO of the photo-coupler 170. Therefore, in the case where the light driving apparatus according to the present disclosure operates in a normal state, the output voltage of the first photo-coupler driving circuit 190 is applied to the input terminal OPTO of the photo-coupler 170, and so the photo-coupler 170 is operated by the constant output voltage of the first photo-coupler driving circuit 190.

In other words, the second photo-coupler driving circuit 200 feeds back the constant voltage output from the sample and hold circuit 180 through the photo-coupler 170 to the power factor correction circuit 130, so that the voltage VOUT supplied to the LED module 10 by the operation of the transformer circuit 120 of the power factor correction circuit 130 maybe maintained at a stable voltage magnitude, particularly at a first target value (for example, 50V).

In addition, as the operation of the constant-current driving circuit 150 is stopped by the control of the dimming control circuit 160, the power factor correction circuit 130 decreases the output voltage of the transformer circuit 120 so that the first photo-coupler driving circuit 190 outputs a high voltage capable of stopping the operation of the transformer circuit 120 to the photo-coupler 170.

In other words, the first photo-coupler driving circuit 190 may further include a fourth switch element SW4 which is switched to turn on/off according to the logic value of the dimming control signal DIM to apply the high voltage VDD to the second reference voltage Vref2 of the fourth amplifier OP4.

When the LED current ILED does not flow by the control of the constant-current driving circuit 150 of the dimming control circuit 160, the fourth switch element SW4 applies the high voltage VDD to the second reference voltage Vref2 of the fourth amplifier OP4, thereby supplying a high voltage capable of stopping of the primary side through the fourth amplifier OP4 to the photo-coupler 170 so that the operation of the primary side is stopped to prevent malfunction of the light driving apparatus.

For example, in the case where the logic value of the dimming control signal DIM is the first logic value, namely when the operation of the constant-current driving circuit 150 is stopped not to flow the LED current ILED since the second switch element SW2 is switched to turn on, the fourth switch element SW4 is switched to turn on to supply the high voltage VDD from the high voltage supplier to the second reference voltage Vref2 of the fourth amplifier OP4, instead of the second reference voltage Vref2 of the reference voltage supplier, so that the fourth amplifier OP4 outputs a high voltage capable of stopping the operation of the primary side.

Accordingly, a power factor compensation controller 132 of the power factor correction circuit 130 drops the gate voltage VG of the switch element SW substantially to '0' to stop the operation of the switch element SW, so that the transformer circuit 120 stops its operation, thereby stopping the operation of the primary side.

At this time, even though the primary side stops its operation, until the logic value of the dimming control signal DIM makes a transition to the second logic value so that the second switch element SW2 is switched to turn off to initiate the operation of the constant-current driving circuit 150, the voltage VOUT supplied to the LED module 10 stably maintains a constant voltage magnitude, particularly a first target value (for example, 50V) due to a high-capacity capacitor of the smoothing circuit 140.

Meanwhile, the second photo-coupler driving circuit 200 includes a plurality of resistance elements R6 and R7 for distributing the output voltage VOUT supplied to the LED module 10, a fifth amplifier OP5 for amplifying the voltage corresponding to a difference value between the voltage distributed by any one resistance element R7 of the plurality of resistance elements and a third reference voltage Vref3 and outputting the amplified voltage, and a sixth amplifier OP6 for amplifying the voltage corresponding to a difference value between the voltage output from the fifth amplifier OP5 and a fourth reference voltage Vref4 and outputting the amplified voltage. At this time, the second photo-coupler driving circuit 200 may further include a reference voltage supplier for supplying the reference voltage.

In addition, the second photo-coupler driving circuit 200 may further include a low pass filter 202 for filtering a waveform of the voltage distributed by the resistance element R7. At this time, the low pass filter 202 may include a resistor R8 and a plurality of capacitors C4 and C5, which connect to each other in series or in parallel.

In the case where the light driving apparatus operates in an abnormal state, namely under the situation where the flow of the LED current ILED is stopped since the LED module 10 is opened, the output voltage Vo of the LED module 10 drops and the voltage VOUT supplied to the LED module 10 continuously boosts to rise over a predetermined value (for example, 60V), the second photo-coupler driving circuit 200 outputs a voltage higher than the first photo-coupler driving circuit 190 to the input terminal OPTO of the photo-coupler 170. Therefore, in the case where the light driving apparatus operates in an abnormal state, the output voltage of the second photo-coupler driving circuit 200 is applied to the input terminal OPTO of the photo-coupler 170, and accordingly the photo-coupler 170 is operated by the output voltage of the second photo-coupler driving circuit 200.

Figure 6:
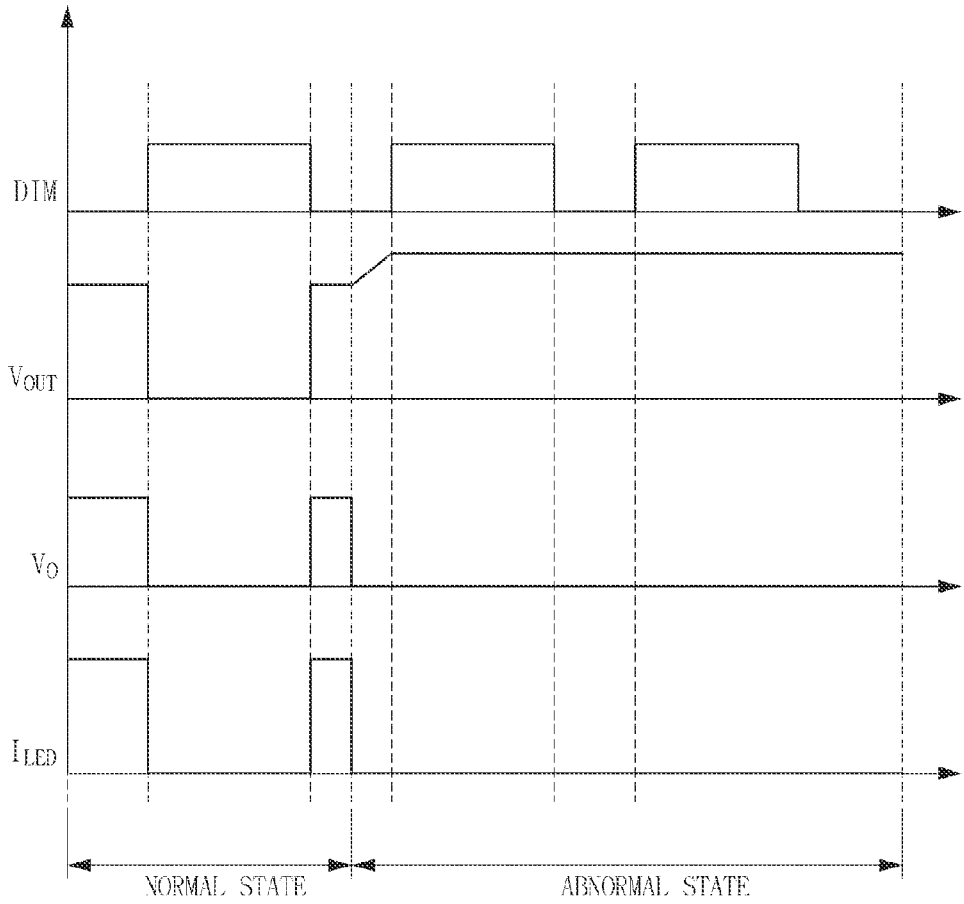

In other words, the second photo-coupler driving circuit 200 feeds back the output voltage VOUT, output from the transformer circuit 120 and supplied through the smoothing circuit 140 to the LED module 10, through the photo-coupler 170 to the power factor correction circuit 130. Accordingly, as shown in FIG. 6, in the case where the LED module 10 is opened so that the LED current ILED is substantially not flowing and the output voltage Vo of the LED module 10 drops to the low voltage, it is possible to prevent the voltage VOUT supplied to the LED module 10 from boosting to a saturation voltage by the operation of the transformer circuit 120 of the power factor correction circuit 130, and the voltage VOUT supplied to the LED module 10 is maintained at a stable voltage magnitude, particularly at the second target value (for example, 60V) having a greater value than the first target value.

In the above configuration, the operations of the light driving apparatus according to an embodiment of the present disclosure will be described.

First, if receiving the PWM signal PWM, the dead time unit 162 of the dimming control circuit 160 outputs the input PWM signal PWM to the dimming control signal DIM intactly to control the constant-current driving circuit 150, endows the dead time regions DT1 and DT2 respectively to a region where the logic value of the PWM signal PWM makes a transition to generate the S/H control signal S/H, and outputs the generated S/H control signal S/H to be input to the sample and hold circuit 180.

For example, if the logic value of the dimming control signal DIM becomes low, the second switch element SW2 of the dimming control circuit 160 is switched to turn off during the time when the low level is maintained from the point T1' that the logic value becomes low to transmit the output voltage of the first amplifier OP1 as a driving signal of the first switch element SW1, thereby driving the constant-current driving circuit 150. Meanwhile, if the logic value of the dimming control signal DIM becomes high, the second switch element SW2 of the dimming control circuit 160 is switched to turn on during the time when the high level is maintained from the point T2' that the logic value becomes high to intercept the transmission of the output voltage of the first amplifier OP1 to the first switch element SW1, thereby stopping the operation of the constant-current driving circuit 150. As the operation of the constant-current driving circuit 150 stops as described above, the current flow of the LED module 10 also stops.

Meanwhile, the constant-current driving circuit 150 controls the current flow of the LED module 10 according to the control of the dimming control circuit 160. At this time, the output voltage Vo of the LED module 10 has a magnitude corresponding to the sum of the voltage applied to the sense resistor Rs and the voltage applied to both ends of the first switch element SW1, for example the voltage applied to both drain-source terminals of the first switch element in the case where the first switch element SW1 is a power transistor.

As the constant-current driving circuit 150 operates as above, the constant current set by the constant-current driving circuit 150 flows through the LED module 10, and accordingly the output voltage Vo of the LED module 10 drops by a predetermined magnitude.

Meanwhile, the sample and hold circuit 180 receives the S/H control signal S/H output from the dimming control circuit 160, samples the output voltage when the S/H control signal S/H has the first logic value, and in the case where the S/H control signal makes a transition from the first logic value to the second logic value, outputs the output voltage sampled when the S/H control signal has the first logic value, thereby maintaining the output at a constant voltage.

In other words, when the S/H control signal S/H output from the dead time unit 162 has the first logic value, the third switch element SW3 of the sample and hold circuit 180 is switched to turn on to transmit the output voltage Vo of the LED module 10 to the input terminal of the second amplifier OP2 and capacitor C1. Meanwhile, when the S/H control signal S/H has the second logic value, the third switch element SW3 of the sample and hold circuit 180 is switched to turn off to intercept the transmission of the output voltage Vo of the LED module 10 to the input terminal of the second amplifier OP2 and capacitor C1.

For example, after the time corresponding to the first dead time region DT1 passes from the point T1' that the logic value of the dimming control signal DIM becomes low, if the logic value of the S/H control signal S/H becomes high, the third switch element SW3 is switched to turn on during the time t1 when the high level is maintained from the point T1 that the logic value becomes high to transmit the output voltage Vo of the LED module 10 to the input terminal of the second amplifier OP2 and capacitor C1. Meanwhile, if the logic value of the S/H control signal S/H becomes low, the third switch element SW3 is switched to turn off during the time when the low level is maintained from the point T2 that the logic value becomes low to intercept the transmission of the output voltage Vo of the LED module 10 to the input terminal of the second amplifier OP2 and capacitor C1.

In the case where the third switch element SW3 is switched to turn on, the second amplifier of the sample and hold circuit 180 receives the output voltage Vo of the LED module from the output terminal of the LED module 10, buffers the voltage corresponding to a difference value between the input output voltage Vo of the LED module and its feedback output voltage as a unit gain, and outputs the buffered voltage. Meanwhile, in the case where the third switch element SW3 is switched to turn off, the second amplifier of the sample and hold circuit 180 receives the charge voltage from the capacitor C1 charged with the output voltage Vo of the LED module, buffers the voltage corresponding to a difference value between the input voltage and its feedback output voltage as a unit gain, and outputs the buffered voltage, thereby applying a voltage of a constant magnitude to the input terminal FB2 of the first photo-coupler driving circuit 190.

Accordingly, even when the S/H control signal S/H has the second logic value, the output voltage when the S/H control signal S/H has the first logic value is transmitted to the input terminal FB2 of the first photo-coupler driving circuit 190. In other words, regardless of the logic value of the S/H control signal S/H output from the dimming control circuit 160 when dimming is controlled, the output voltage of the sample and hold circuit 180 sampled when the S/H control signal S/H has the first logic value is always maintained.

After that, the first photo-coupler driving circuit 190 is operated with the voltage output from the sample and hold circuit 180 and always having a constant magnitude and outputs an output voltage always having a constant magnitude through the output terminal OPTO to stably drive the photo-coupler 170.

When operating to control dimming of the light driving apparatus, since the photo-coupler 170 operates with the voltage received from the first photo-coupler driving circuit 190 and always having a constant magnitude, the feedback voltage FB always having a constant magnitude may be stably output so that the light driving apparatus may maintain the output voltage VOUT always having a constant magnitude. Accordingly, a driving current always having a stable magnitude flows through the LED module 10.

Meanwhile, in the case where the logic value of the dimming control signal DIM becomes high and the second switch element SW2 is switched to turn on to stop the operation of the constant-current driving circuit 150 so that the LED current ILED stops flowing, a malfunction such as boosting of the output voltage of the transformer circuit 120 caused by the operation of the power factor correction circuit 130 may occur. At this time, if the logic value of the dimming control signal DIM becomes high, the fourth switch element SW4 is switched to turn on during the time when the high level is maintained from the point T2' that the logic value becomes high to supply the high voltage VDD to the second reference voltage Vref2 of the fourth amplifier OP4, thereby controlling the operation of the primary side so that the voltage VOUT supplied to the LED module 10 is maintained at a stable voltage magnitude.

Meanwhile, in the case where the light driving apparatus operates in an abnormal state, namely if the LED module 10 is opened to stop the flow of the LED current ILED so that the output voltage Vo of the LED module 10 drops and the voltage supplied to the LED module 10 continuously boosts to rise over a predetermined value (for example, 60V), the second photo-coupler driving circuit 200 outputs a higher voltage in comparison to the first photo-coupler driving circuit 190 to the input terminal OPTO of the photo-coupler 170, and accordingly, the photo-coupler 170 is operated by the output voltage of the second photo-coupler driving circuit 200. At this time, the second photo-coupler driving circuit 200 feeds back the output voltage VOUT, output from the transformer circuit 120 and supplied to the LED module 10, through the photo-coupler 170 to the power factor correction circuit 130.

In this case, the power factor correction circuit 130 repeatedly lowers the voltage VOUT supplied to the LED module 10 so that the output voltage of the second photo-coupler driving circuit 200 drops and the voltage applied to the photo-coupler 170 drops, and in this way, the voltage VOUT supplied to the LED module 10 is lowered and maintained at a stable voltage magnitude, namely at a second target value (for example, 60V).

The light driving apparatus according to the present disclosure is not limited to the above embodiments, but may be changed or modified in various ways within the scope of the present disclosure.

What is claimed is:

1. A light driving apparatus, comprising:

a rectifier circuit for rectifying a full wave output from a power source;

a transformer circuit for converting a magnitude of the voltage output from the rectifier circuit and outputting the converted voltage;

a power factor correction circuit for detecting a load size by using a feedback voltage, and adjusting the output voltage of the transformer circuit according to the detected load size to compensate a power factor of the power source;

a smoothing circuit for smoothing the voltage output from the transformer circuit, outputting the smoothed voltage, and supplying the output voltage to an LED module;

a constant-current driving circuit for controlling an LED current so that a constant driving current flows through the LED module;

a dimming control circuit for controlling the constant-current driving circuit to adjust a current flow of the LED module so that dimming is controlled;

a photo-coupler for applying the feedback voltage to the power factor correction circuit;

a sample and hold circuit operated according to the control of the dimming control circuit to maintain a consistent output voltage;

a first photo-coupler driving circuit for feeding back the voltage output from the sample and hold circuit and applying the feedback voltage as a driving voltage of the photo-coupler; and a second photo-coupler driving circuit for feeding back the voltage output from the smoothing circuit and supplied to the LED module, and supplying the feedback voltage as a driving voltage of the photo-coupler.

2. The light driving apparatus according to claim 1, wherein the power factor correction circuit decreases the magnitude of the output voltage of the transformer circuit as the photo-coupler is operated by a high voltage, and increases the magnitude of the output voltage of the transformer circuit as the photo-coupler is operated by a low voltage.

3. The light driving apparatus according to claim 2, wherein the output terminal of the first photo-coupler driving circuit and the output terminal of the second photo-coupler driving circuit respectively have a diode for preventing a reversal of current, and wherein the output terminal of the first photo-coupler driving circuit and the output terminal of the second photo-coupler driving circuit connect to the input terminal of the photo-coupler in parallel.

4. The light driving apparatus according to claim 3, wherein the second photo-coupler driving circuit includes:

a plurality of resistance elements for distributing the voltage supplied to the LED module;

a first amplifier for amplifying the voltage corresponding to a difference value between the voltage distributed by any one resistance element among the plurality of resistance elements and a first reference voltage and outputting the amplified voltage;

a second amplifier for amplifying the voltage corresponding to a difference value between the voltage output from the first amplifier and a second reference voltage and outputting the amplified voltage; and a reference voltage supplier for supplying the reference voltages to the first amplifier and the second amplifier.

5. The light driving apparatus according to claim 4, wherein, as the driving of the constant-current driving circuit stops according to the control of the dimming control circuit, the power factor correction circuit decreases the output voltage of the transformer circuit so that the first photo-coupler driving circuit applies a high voltage capable of stopping the transformer circuit to the photo-coupler.

6. The light driving apparatus according to claim 5, wherein the first photo-coupler driving circuit includes:

a third amplifier for amplifying the voltage corresponding to a difference value between the voltage output from the sample and hold circuit and a third reference voltage and outputting the amplified voltage;

a fourth amplifier for amplifying the voltage corresponding to a difference value between the voltage output from the third amplifier and a fourth reference voltage and outputting the amplified voltage;

a reference voltage supplier for supplying the reference voltages to the third amplifier and the fourth amplifier; and a switch element switched by the control of the dimming control circuit so that, as the driving of the constant-current driving circuit stops, the power factor correction circuit decreases the output voltage of the transformer circuit to the fourth reference voltage of the fourth amplifier, thereby applying a high voltage capable of stopping the operation of the transformer circuit.

7. The light driving apparatus according to claim 1, wherein the constant-current driving circuit includes:

a zener diode connected to a ground terminal;

a sense resistor connected to the output terminal of the LED module;

a fifth amplifier for amplifying the voltage corresponding to a difference value between the voltage applied to the first zener diode and the voltage applied to the sense resistor and outputting the amplified voltage; and a first switch element switched to turn on/of according to the voltage output from the fifth amplifier to adjust a current flow of the LED module.

8. The light driving apparatus according to claim 7, wherein the dimming control circuit includes:

a dead time unit for receiving a pulse width modulation (PWM) signal generated from a PWM controller and outputting a dimming control signal and a S/H control signal; and a second switch element switched to turn on/off by the dimming control signal to transmit the output voltage of the fifth amplifier as a driving signal of the first switch element or intercept the transmission, thereby controlling the operation of the first switch element.

9. The light driving apparatus according to claim 8, wherein, when receiving a PWM signal from the PWM controller, the dead time unit outputs the input PWM signal as a dimming control signal, and endows a dead time region corresponding to each non-overlap time region to a transition region of a logic value of the PWM signal to generate and output the S/H control signal.

10. The light driving apparatus according to claim 8, wherein the sample and hold circuit samples the output voltage when the S/H control signal output from the dimming control circuit has a first logic value, and in the case where the S/H control signal make a transition from the first logic value to a second logic value, the sample and hold circuit outputs the output voltage sampled when the S/H control signal has the first logic value.

11. The light driving apparatus according to claim 10, wherein the sample and hold circuit includes:

a capacitor charged with the output voltage of the LED module;

a sixth amplifier for buffering the output voltage of the LED module or the voltage corresponding to a difference value between the charge voltage of the capacitor and the input voltage as a unit gain and outputting the buffered voltage, the output voltage being fed back and used as the input voltage; and a third switch element switched to turn on/off according to the logic value of the S/H control signal to transmit the output voltage of the LED module to the sixth amplifier and the capacitor or intercept the transmission.

12. The light driving apparatus according to claim 11, wherein, after a time corresponding to a first dead time region passes from the point when the logic value of the dimming control signal becomes the second logic value, in the case where the logic value of the S/H control signal becomes the first logic value, the third switch element is switched to turn on during the time when the first logic value is maintained from the point when the logic value becomes the first logic value to transmit the output voltage of the LED module to the input terminal of the sixth amplifier and the capacitor, and in the case where the logic value of the S/H control signal becomes the second logic value, the third switch element is switched to turn off during the time when the second logic value is maintained from the point that the logic value becomes the second logic value to intercept the transmission of the output voltage of the LED module to the input terminal of the sixth amplifier and the capacitor.

* * * * *